United States Patent [19]

Matalon

[11] 4,226,277

[45] Oct. 7, 1980

[54] NOVEL METHOD OF MAKING FOUNDRY MOLDS AND ADHESIVELY BONDED COMPOSITES

[76] Inventor: Ralph Matalon, 432 Cherry Hill Blvd., Cherry Hill, N.J. 08034

[21] Appl. No.: 920,499

[22] Filed: Jun. 29, 1978

[51] Int. Cl.[2] ..... B22C 9/12; B22C 1/18

[52] U.S. Cl. ..... 164/7; 164/12

[58] Field of Search ..... 164/7, 12, 15, 16, 21, 164/160, 253, 254, 255, 165, 166; 106/38.5 R

[56] References Cited

U.S. PATENT DOCUMENTS

| | | | |
|---|---|---|---|
| 1,077,958 | 11/1913 | Gleason | 106/38.3 |
| 1,091,690 | 3/1914 | Moore | 312/138 R |
| 1,153,230 | 9/1915 | Jacobs | 428/428 |
| 1,879,272 | 9/1932 | Inkley | 106/38.3 |
| 1,975,398 | 10/1934 | Malaspina | 106/38.6 |
| 1,976,009 | 10/1934 | De Bats | 164/35 |
| 2,128,404 | 8/1938 | Dunbeck | 106/38.3 |
| 2,193,346 | 3/1940 | Ruddle | 106/38.35 |
| 2,214,349 | 9/1940 | Ruddle et al. | 106/38.35 |
| 2,322,638 | 6/1943 | Kleeman | 106/38.35 |
| 2,322,667 | 6/1943 | Seastone | 106/38.3 |
| 2,367,648 | 1/1945 | Nichols | 164/12 |
| 2,368,322 | 1/1945 | Passelecq | 70/374 |
| 2,424,895 | 7/1947 | Noyes | 106/38.35 |
| 2,701,902 | 2/1955 | Strachan | 164/20 |
| 2,703,913 | 3/1955 | Hinde | 164/25 |
| 2,732,600 | 1/1956 | Hanink et al. | 164/14 |
| 2,749,586 | 6/1956 | Kohl et al. | 164/8 |
| 2,755,192 | 7/1956 | Mahoney | 106/38.23 |
| 2,806,270 | 9/1957 | Shaul | 164/26 |
| 2,829,060 | 4/1958 | Emblem | 164/16 |
| 2,861,893 | 11/1958 | Lynwood | 106/38.35 |
| 2,881,081 | 4/1959 | Henricks | 106/38.3 |
| 2,883,723 | 4/1959 | Moore et al. | 164/16 |
| 2,895,838 | 7/1959 | Henda | 106/38.3 |
| 2,896,280 | 7/1959 | Henda et al. | 156/336 |
| 2,905,562 | 9/1959 | Brown | 106/12 |
| 2,905,563 | 9/1959 | Ilenda et al. | 106/38.35 |
| 2,926,098 | 2/1960 | Ilenda et al. | 106/38.35 |
| 2,928,750 | 3/1960 | Watts | 106/38.3 |
| 2,945,273 | 7/1960 | Herzmark et al. | 164/16 |
| 2,947,641 | 8/1960 | Bleuenstein | 106/38.3 |
| 2,952,553 | 9/1960 | Ilenda et al. | 106/38.3 |
| 2,975,494 | 3/1961 | Cooper | 164/43 |
| 2,977,650 | 4/1961 | Ilenda et al. | 156/336 |
| 2,988,454 | 6/1961 | Aberegg | 106/38.35 |
| 3,028,340 | 4/1962 | Gandon | 252/313.5 |
| 3,032,426 | 5/1962 | Lee | 106/38.35 |
| 3,050,796 | 8/1962 | Moore | 164/41 |
| 3,074,802 | 1/1963 | Alexander et al. | 106/38.3 |
| 3,093,493 | 6/1963 | Freyhold | 106/14.44 |
| 3,094,422 | 6/1963 | Reinhold | 106/38.3 |
| 3,109,211 | 11/1963 | Wagner | 106/38.35 |
| 3,137,046 | 6/1964 | Barlow | 164/16 |
| 3,203,057 | 8/1965 | Hunt et al. | 164/21 |
| 3,214,287 | 10/1965 | Mosna | 427/318 |
| 3,218,683 | 11/1965 | Nishiyama et al. | 105/38.3 |
| 3,230,099 | 1/1966 | Cooper | 75/168 R |
| 3,255,024 | 6/1966 | Alexander et al. | 106/38.3 |
| 3,326,701 | 6/1967 | Freyhold | 106/38.35 |
| 3,385,345 | 5/1968 | Miraldi | 164/43 |
| 4,043,380 | 8/1977 | Valentine | 164/15 |

FOREIGN PATENT DOCUMENTS

| | | | |
|---|---|---|---|
| 2057263 | 5/1971 | France | 164/16 |
| 43-18122 | 8/1968 | Japan | 164/12 |
| 48-32055 | 10/1973 | Japan | 164/12 |
| 1309606 | 3/1973 | United Kingdom | 164/16 |

*Primary Examiner*—Robert D. Baldwin
*Assistant Examiner*—K. Y. Lin
*Attorney, Agent, or Firm*—Brumbaugh, Graves, Donohue & Raymond

[57] ABSTRACT

The present invention concerns the use of an aqueous solution of a silicate as a binder, particularly for hardening foundary molds and cores without the use of acid or other reagents to convert the silicate into a silican gel. According to the present invention, the silicate binder is not reacted but instead is rapidly dried, preferably enough within the space of 5 seconds to 10 minutes to reduce the initial water content of the aqueous silicate solution by at least 25%. In the preferred embodiments, this is achieved by forcing air through opposed porous sides of the mold box and the green sand contained therein. The present invention is also applicable to other composite forms such as the manufacture of plywood, particle board, briquettes, and the like.

27 Claims, 2 Drawing Figures

NOVEL METHOD OF MAKING FOUNDRY MOLDS AND ADHESIVELY BONDED COMPOSITES

This application relates generally to the manufacture of molds and cores for the casting of metals.

Metals such as light alloys, aluminum, bronze, gray irons and steels are frequently cast with the aid of casting forms such as cores and molds made of particles of a foundry sand bound together with a suitable binder. One type of binder which has been extensively used in the foundry industry is an aqueous solution of a soluble silicate such as sodium silicate, i.e. water glass.

Aqueous solutions of alkaline silicates are generally known to have adhesive properties, see, for example, Houwink et al. "Adhesion and Adhesives", Elsevier Publishing Co. 1965; Volume I, chapter 8; Vail "Soluble Silicates" Rheinhold Publishing Co. 1952. Adhesion must be developed, however, by slow drying below the boiling point of water to avoid distruction of the adhesive film. (Vail supra, Vol. II; page 411). Because of the need for relatively slow drying, other means of rapid hardening the sodium silicate are required. To provide the rapid hardening required in practical foundry operation, it has become known to use an acidic gas such as carbon dioxide or hydrochloric acid which rapidly converts the silicate into silica gel with a liberation of water and an alkaline carbonate. After an initial set has been obtained, the mold may then be baked to prepare it for use.

The carbon dioxide-hardened, silicate-bound foundry sand, however, has generally been recognized to lack adequate strength particularly under the conditions of high production volume such as encountered in the automotive industry. Accordingly, for the past twenty years foundry sand users have sought alternatives to the use of silicate as a binder for foundry sands. These alternatives have resided largely in the use of a variety of synthetic resins which are cured to provide the desired set to the mold.

One such technique which has been suggested is a so-called hot box procedure in which a liquid resinous composition, typically of the phenol or furan type, is mixed with the foundry sand and packed into a mold box. Alternately, others have suggested using dry powdered resinous compositions blended with the sand. In any event, the resinous compositions are heated to fuse the resin, sometimes using a liquid or gaseous material to facilitate hardening of the mold. Heat curing, however, presents handling difficulties, since the worker must take precautions to avoid being burned by the hot heated cured mold. Moreover, during casting, the hot metal causes decomposition of the resin binder. This can result in the release of noxious gases that must be disposed of and in some cases, require special safety precautions to avoid exposure of the workers involved. Not infrequently, the resinous systems also present fire hazards.

Powdered resins have other disadvantages as well. The powder resin, since it has a substantially different density from the foundry sand, tends to segregate during mixing and handling which results in an uneven distribution of binder and an improperly bonded mold. Further, the powdered resin separates or dusts out during handling and mixing, and the resin dust resulting creates an additional air pollution hazard.

Still another procedure which has been proposed for binding foundry sands is described in U.S. Pat. No. 3,409,579, which concerns a binder composition containing a phenolic resin which combines with a polyisocynate to cross link without heating. The procedure of this patent avoids the necessity of the hot box curing. However, curing in this case requires the use of a tertiary amine which has liquid triethylamine which presents serious difficulties in handling from the safety standpoint.

The use of furan resin bonded sands which are hardened with sulfur dioxide have also been proposed. Here also there are obvious drawbacks associated with use and disposition of a noxious gas used to harden the sand.

SUMMARY OF THE INVENTION

I have now discovered a new method for preparing rapidly hardened silicate bound sands in which only a relatively low amount of silicate is required—usually less than 3% by weight of the sand. In accordance with the present invention a green foundry sand is prepared using an aqueous silicate binder and packed into a mold box containing the pattern to be duplicated using commercial techniques such as blowing, etc. Optionally, (and preferably) adjuvants which are more fully described below are used to improve the setting and shake-out properties of the mold. The sand is cured by rapidly removing water from it sufficiently to cause the sand to set. Typically, such rapid setting is achieved by removing 30% or more of the water in less than 10 minutes; in preferred practice, less than one to two minutes. The present invention provides a method by which silicate-bonded sands will yield instant tensile strength substantially in excess of the instant tensile strength obtainable with the corresponding sands hardened by carbon dioxide gasing.

The procedure of the present invention is quite surprising since the only example known to me previously of using air dried silicate binders in foundry practice is in the construction of investment molds such as described for example in U.S. Pat. No. 2,945,273 to Herzmark et al. In investment casting usually two or three layers of a sand-water glass mixture are applied to a wax pattern and hardened by exposure to an acidic gas such as carbon dioxide or hydrochloric acid. Additional layers of the sand-water-glass mix are then applied and hardened by a current of warm air. In this instance, air hardening of the investment mold is slow, requiring as much as 30 to 40 minutes under the influence of the warm air stream to harden each layer, and is limited to drying of relative thin films. So far as I am aware, drying three dimensional permeable objects bonded by soluble silicates, in the manner of the present invention has not heretofore been suggested.

DETAILED DESCRIPTION OF INVENTION

Figure 1:
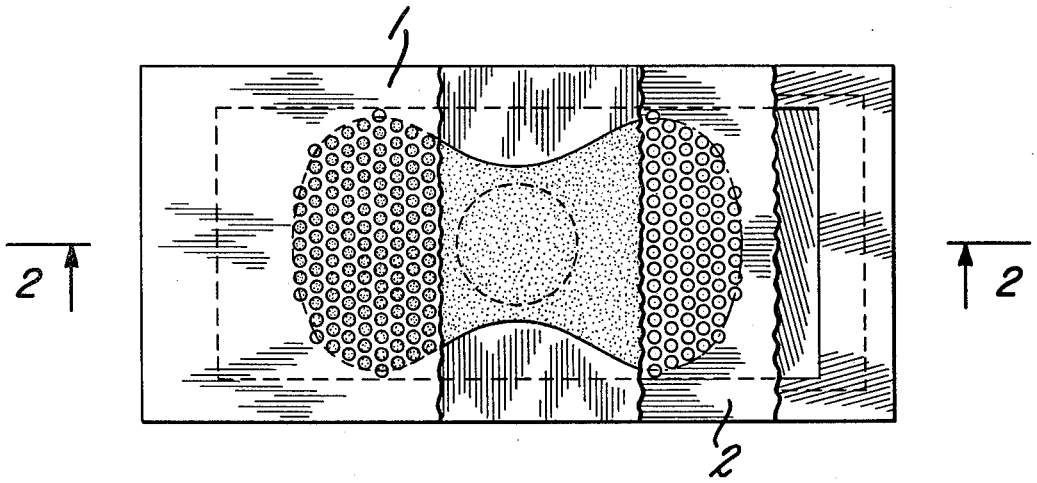

As indicated generally above, the present invention involves combining foundry sands, silicate binders and, optionally, adjuvants, which are cured in a novel manner to produce molds and cores having high initial strength and scratch resistance. In more detail, the materials used in the invention are the following:

Foundry sands

The present invention is applicable generally to the conventional foundry sands available in the art. Many such sands are known. Those denoted as subangular are industrially used, as well as those containing a higher percentage of spherical or rounded particles. Lake sand, Wedron sand, and Ottawa sands are all especially desirable. Also usable are refractory material such as zircon sands, olivine sands, carbon, refractory oxides and other refractory particulate substances. It is preferred that the sand not contain significant portions of impurities such as organic matter, silt, clays or other collodial matter, lime and the like. Some impurities are especially undesirable as they tend to react with or to absorb the silicate binder, or interfere with its coating capacity and binding strength.

Foundry sands are preferably dry and free flowing. Their size may be varied according to the particular usage and may range from coarse (from 50 to 70 mesh) to fine (as 150 mesh) and even as fine as 250 mesh. However, because the present invention depends on rapid withdrawal of water from the silicate binder in the interior of the mold, it is preferable to avoid fine mesh sands unless they are necessary to the surface finish of the cast article. Relatively coarse sands, for example, having an average mesh size of 50–70, permit passage of drying air through the mold and cores more easily than do fine sands, such as sands having an average particle size of 120 mesh which generally doubles the drying time at a fixed pressure drop.

Silicate Binder

The simplest silicate binders for purposes of the present invention are exemplified by water glass, i.e., sodium silicate containing silica, sodium oxide and water in varying proportions. It is, of course, well known that there are a variety of alkali metal silicates, and all of these may be used in substitution for sodium silicate. Such other common alkali metal silicates are potassium silicate and lithium silicate. Also usable are "ammoniated" silicates, that is, alkali metal silicates to which ammonium hydroxide has been added. These generally, and preferably, have a high ratio of silica to soda (or alkali metal oxide) such as 2.2 or higher. Also quaternary ammonium silicate can be used in combination with the alkali metal silicate. Such quaternary ammonium silicate are described, for example in U.S. Pat. Nos. 3,239,521, 3,345,194 and 3,372,038.

Silicate binders generally have silica to metallic oxides mole ratios of 1:1 to 4:1, and preferably from 2:2:1 to 3:2:1. These proportions correspond generally to metasilicates, disilicates, trisilicates or higher silicates. Such silicates in solution are characterized by increasing amounts of branched rings and complex structures characterized as "polysilicate anions", and it is believed that it is the branched ring and complex structure which give rise to the binding properties of aqueous silicates.

The silicate binder also contains water to form a syrup-like aqueous composition having colloidal or gel-like film-forming characteristics. In commercially practicable silicates, there is generally from 47 to 70% water, the soluble silicate solution having a viscosity ranging from 100 up to 50,000–70,000, depending upon the amount of water and the composition of the silicate. I have had best results in using, as the soluble silicates, sodium silicate "N", sodium silicate "K", sodium silicate "RU" and sodium silicate "D" of the Philadelphia Quartz Company. The grade "N" soluble silicate contains silica to sodium oxide in a 3.22 weight ratio, the syrup containing 37.2% sodium silicate solids, having a density of 41.0° Be and a viscosity of 180° cp. Grade "K" has a $SiO_2$:$Na_2O$ ratio of 2.88 and contains 42.7% solids. Grade "RU" has a silicate to sodium oxide weight ratio of 2.40, a solids content of 47%, a density of 52.0° Be and a viscosity of 2100 cp. Grade "D" has a $SiO_2$:$Na_2O$ ratio of 2.0 contains 44.1% solids.

Sodium oxide when present in a soluble silicate binder tends to reduce the melting point of the foundry sand. This imparts adverse shake-out properties, and is more severe with more alkaline water glasses, notwithstanding that the more alkaline silicates produce better tensile properties in the mold. At the same time, however, while a soluble silicate containing a high ratio of silicate to soda such as 3.6, for example, affords favorable shake-out characteristics, it tends to produce relatively weak binding. Accordingly, there is a desire notwithstanding the adverse effect of soda to use a soluble silicate of the highest practical alkalinity—lowest practical ratio of silicate to soda.

In part, this difficulty can be mitigated by replacing some of the sodium oxide of water glass by other alkali metal oxides such as potassium. Such other alkali metals have a lesser tendency than does sodium to flux the foundry sand and lower its fusion point, but they add to the expense of the binder.

It is preferred, and an important discovery in its own right in accordance with the present invention, to add ammonia or a quaternary ammonium compound to the sodium silicate for the purpose of increasing its alkalinity without introduction of adverse quantities of sodium oxide. In this aspect of the invention it is preferred, therefore, to use a sodium silicate containing a silica to sodium ratio of 2.2 or higher (but preferably not higher than 3.2) to which ammonia is added up to an amount which increases the effective alkalinity of the mixture to the equivalent of a sodium silicate having silica to metal oxide ratio of 1.8 to 2.2. This is calculated by treating 1 mole of ammonia as the equivalence of 1 mole of sodium hydroxide. This aspect of the invention is particularly surprising because it had been thought heretofore that addition of ammonia to sodium silicate tended to convert the sodium silicate to an insoluble gel. I have found that, upon addition of ammonia, if a mixture is stirred vigorously for at least 30 minutes if gellation occurs, and is allowed to age for several hours (or preferably a day or more) at room temperature, the homogeneity of the ammoniated sodium silicate reappears and the mixture indeed becomes less viscous than the original sodium silicate.

The ammoniated silicate provides a binder with exceptional tensile properties. Moreover, because the ammonia is volatile under the influence of sand drying and heat of casting, the ammonia evaporates leaving behind a mold of excellent shake-out properties and because the introduction of soda is limited, the foundry sand retains its reuseability for a greater period of time.

Adjuvants

Another method which I can use for reducing the tendency of the silicate binder to form glass-like substances during casting is to include in it adjuvants which improve the shake-out characteristics of the silicate binder. In general such binders, under the influence of heat during casting will decompose in a manner that disrupts the strength of the film or binding action of the silicate. For example, additives carbonize upon exposure to temperatures of the casting metal, and may evolve small amounts of gases at such temperatures. This facilitates shake-out of the mold and cores from the finished casting. According to this invention, preferred adjuvants are film forming materials which will also enhance the drying and strength properties of the silicate binder, so that the same or even improved strength is obtained with reduced amount of silicate.

The additives are preferably miscible with the silicate binder or dispersible therein, and have no detrimental effect on it. It has been found that a small amount of gas formed in the sand of the mold and core contributes to good casting. However, excessively gassy adjuvants should be avoided since large amounts of gas will cause porous castings, and adversely affect the cast surfaces and dimensional integrity of the casting. Additives rich in nitrogen, for example, are not preferred for this reason.

A great number of additives have been used in silicate binders. These are:

1. Alumina, borax, and various inorganic clays, such as kaolin, bentonite, iron oxide, silica flour, and graphite.

2. Resinous or polymeric film forming compositions exemplified by phenol-formaldehyde resins, urea-formaldehyde resins, ureaphenol-formaldehyde resins, urea-furfural resins, bituminous resins, rosin, shellac, styrene-butadiene latexes, and polyvinyl acetate.

3. Sugars such as sucrose, dextrose, and glucose, including forms of commercial glucose produced by hydrolysis of carbohydrates, fructose, lactose, mannose, levulose and maltose, and blends thereof. Also suitable are substances such as corn syrup containing one or more of the foregoing, as well as polysaccharides when used in combination with urea resins. The reducing sugar reaction with the formaldehyde to provide a binder enhances the binding properties of the silicate used as a primary binder.

4. Special additives more fully described below which I have discovered for use with silicate binders in accordance with the present invention provide exceptional results and are preferred.

5. Various mixtures of the foregoing materials can also be used if desired.

The preferred adjuvants are generally those of the second through fourth class described above. The additives of the first category—i.e. various inorganic substances, have the disadvantage that they tend to add fines to the sand, and because of this, their use must be limited so as not to reduce permeability and increase resistance to air flow of the green sand. These characteristics interfere with the desired rapid drying of the silicate binder in accordance with the present invention.

Adjuvants of groups 2 through 4, when used, are desirable because they permit blending of a binder composition containing reduced amounts of silicate. Thus, for example, a sand may be formed using 3%–5% binder of which possibly one-half may constitute the adjuvant, the remaining major portion being a silicate binder. Thus, the effective silicate content of the binder is reduced so that upon reuse of the foundry sand after the casting has been completed, the accumulation of low melting alkali metal oxides is reduced.

One class of adjuvant useful in the present invention are those described in my British Pat. No. 1,309,606. Such adjuvants are a condensation product of a syrupy mixture composed of 44–77% reducing sugar, 5–22% urea, 4–19% formaldehyde, and 9–18% water. The mixture is reacted at a pH of 5–6 for 15–120 minutes at 110°–118° C. For application in the present process these may be modified by reducing the amount of urea and formaldehyde.

As indicated, however, preferred adjuvants are those which have been specially formulated for use with foundry sands bound by a soluble silicate in accordance with the present invention. These preferred adjuvants are formed from (i) a reducing sugar such as glucose, pure syrup or other reducing sugars such as mentioned above; (ii) a lower dibasic carboxylic acid or acid anhydride such as maleic acid, maleic anhydride, succinic acid, succinic anhydride, tartaric acid or anhydride, citric acid, tartaric acid, etc. and; (iii) a stabilizer to prevent caramelization of the reducing sugar that the process and temperatures required, I have found that boric acid is generally suitable as a stabilizer. In general, the lower dibasic carboxylic acid should contain from 3 to 6 carbon atoms, be miscible with the reducing sugar at the processing temperature, and may contain hydroxy groups. Optionally there may also be included polyhydric alcohols containing 2 to 8 carbon atoms and 2 to 6 hydroxy groups, which alcohols function as a plasticizer, typical such alcohols are ethylene glycol, propylene glycol, glycerine, pentaerithritol and sorbitol.

The foregoing ingredients are blended together to form a mixture containing (on a dry weight basis) from 1 to 12% of the dibasic carboxylic acid anhydride and preferably from 1 to 3%; from ½ to 2% of the stabilizer (such as boric acid), and preferably from ½ to 1%; and from 0 to 6% of the optional polyhydric alcohol, preferably from 0 to 4%. The balance of the composition is made up of the reducing sugar. The reducing sugar may be either as a dry powder or as an aqueous syrup containing up to 20% water. The foregoing proportions are based on the weight of the dry ingredients.

The mixture is heated to remove any water contained in the reducing sugar as well as the water of condensation. Heating generally is for a period of 30 to 90 minutes at a temperature of 110° to 150° C. The heating step should preferably not be carried on as long as to cause caramelization or thermodegregation of the adjuvant. After heating to remove water, while the reaction mixture is still hot, an aqueous alkali is then added, such as an alkali metal hydroxide (NaOH, KOH, etc.) or ammonia. The amount of alkali and water added at this stage should be sufficient to provide from 10 to 25% water in the final product, and from about ½ to 2% alkali. The amount of alkali added should be sufficient to neutralize unreacted carboxylic acids and to aid in the dilution process. After cooling, the finished product is a syrupy fluid.

Formulation

The sand, silicate binder and (optionally) adjuvants, are mixed in standard mixers or mullers. It is desirable to accomplish the mixing at rapid speeds to minimize costs and increase output for high production foundry sands. Thorough mixing in about 1–2 minutes is a desirable and readily attainable standard.

Generally, the silicate binder compositon is provided in an amount sufficient to yield a green sand containing from .1% to 6% silicate. However, in preferred foundry practice, the green sand will contain 0.5% to 3% by weight of silicate binder or more preferably 1–3% by weight. The lowest binder content consistent with the requisite strength is desirable because too high a binder content destroys the porosity of the foundry sand. Reduced porosity restricts the gas flow required to set the sand, as well as gas flow through the mold when contacted by hot metal.

The adjuvant is used in proportions generally sufficient to promote breakup of the binder under the influence of the heat of the molten metal. The adjuvant preferably has film-forming and plasticizing characteristics which aid the strength of the silicate binder prior to the casting, and, upon casting, decomposes to breakup the film of silicate binding material thereby providing improved shake-out characteristics to the mold. The adjuvant is used in proportions generally sufficient to promote the breakup of the binder under the influence of heat of the molten metal during casting. Depending on the adjuvant selected, the desired portion of adjuvant may range from 25% to as much as 200% adjuvant based on the weight of the silicate binder, preferably from 50% to 150% adjuvant. As indicated above, an advantage of using an adjuvant is that it decreases the amount of silicate required for binding in a particular sand composition, thereby reducing the accumulation of alkali metal oxides when the sand is reused. For this reason, therefore, it may be preferred to increase the amount of adjuvant relative to the amount of silicate consistent with the requirements of good casting performance.

Dehydration and Hardening

In accordance with the present invention, it has been found that green sands prepared with an aqueous soluble silicate binder should be rapidly hardened, in the space of a few minutes or seconds by forced evaporation of water from the silicate binder.

It has been found, surprisingly, that if the green sand is force-dried to remove water rapidly, vastly improved results are obtained. Rapid water removal can be accomplished by electronic heating, for example, by microwave heating, which generates heat, volumetrically within the mass of the mold and core. In this embodiment, the green sand is packed in a mold box, using a pattern, of wood, plastic or other non-conductive materials, which are porous and thereby permit the escape of water vapor as it is evaporated from the sodium silicate. When electronic heating is used, obviously metal must be excluded from the mold box as well as the general vicinity of the mold box area and therefore from the standpoint of practical foundry practice has certain disadvantages. Electronic heating is best applied on silicate bonded cores which have been taken out of the mold box and which retains their shape prior to hardening by virtue of the cohesiveness and the green strength of the sand.

Preferred practice, therefore, is to construct a mold box having two or more air permeable sides adapted to permit air to be forced or drawn through the body of the mold and core by application of air pressure or vacuum. A simple mold box is illustrated in FIGS. 1 and 2 in which FIG. 1 is a plan view of the mold box showing, by broken-away sections, the air permeable faces and mold cavity; and FIG. 2 is a side view through line 2—2 of FIG. 1.

Figure 2:
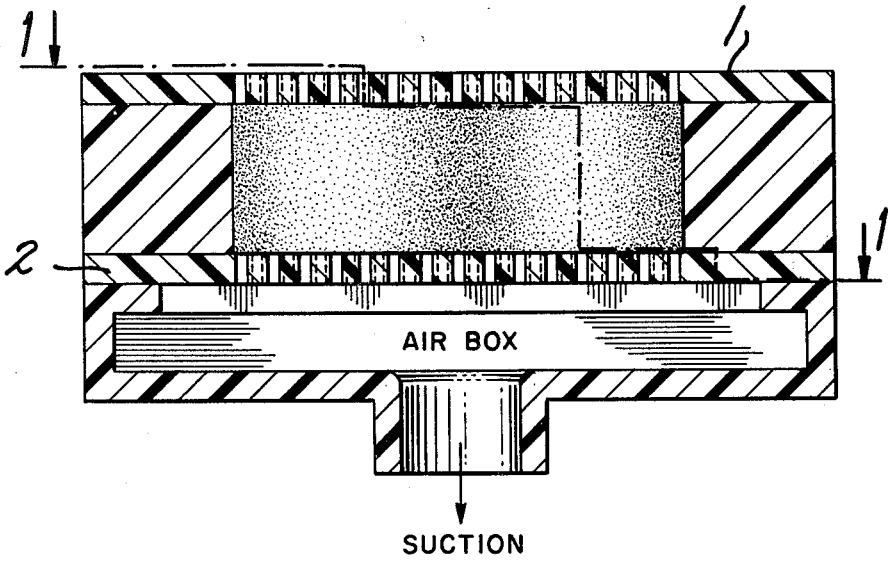

In the simple embodiment illustrated in FIGS. 1 and 2 of this application, the top 1 and bottom 2 of the mold box are provided with perforated faces. Typically, perforations are spaced on 1/10 inch to ¼ in. centers, the perforations being sufficient in size to provide at least 1.5 to 10% open area. Preferably 3½ or greater open area is provided. Greater open area can be added, but does not materially improve results. Slots providing equivalent ventilation of the mold faces 1 and 2 may also be used. Better results are obtained if the perforations are more closely spaced. Alternately, the faces 1 and 2 of the mold may be of air permeable substances such as sintered metal, sintered glass, open-cell plastic foams, or wire screen of various composite materials. For best results, the mold box is designed so that the area of the opposing ventilation faces relative to the volume of the core and mold to be hardened is as large as practical. This will ordinarily result if the ventilated faces of the mold box are positioned so that air is forced or drawn across the thinnest section of the mold.

According to this invention, the core and mold can be fully or partially hardened before removal. Silicate binders rapidly reach their potential strength in the practice of this invention with adequate air ventilation in less than 40 seconds. Ventilation of the mold and core for a shorter period of time, for example, 10 seconds, will result in a core which has been hardened in the vicinity of the face where air enters, but may still be soft or plastic on the exit face of the mold. Such molds and cores, however, continue to harden after removal from the mold box and rapidly reach their ultimate strength characteristics.

While the present invention can be practiced using air at ambient temperatures, more rapid curing is obtained when using air at temperatures of 100° F. to 230° F., or such other temperature as is suitable provided that the mold is not heated during hardening by the warm air to a point which creates a handling problem when removing the hardened mold from the mold box.

For most purposes, in the practice of the present invention, it will be sufficient to provide for an air flow rate in the range of 100 CFM to about 1500 CFM. The flow rate of air required is depended to some extend on the amount of sand to be cured and the thickness of the mold which the drying air must traverse. Air may be supplied either by a suitable blower and compressor providing air at sufficient pressure, bearing in mind the permeability of the mold and the mold faces which the air must traverse to provide the desired hardening. Ordinarily, 5 to 30 lbs. pressure will be quite adequate. Under some conditions it may be desirable to employ higher pressure; however in such cases, of course, the mold box must have sufficient mechanical strength to withstand the pressure drop across it during hardening. Alternately, air may be drawn through the mold box by applying suction to one face.

The air is forced through the mold box containing a green sand for a period of 5 seconds to several minutes, during which time the mold and core will achieve an initial set sufficient to permit handling and to lose 25% or more of the water originally present in the binder. The water content of the silicate binder should usually be decreased so that the "dried" binder is at least 54% solids. Accordingly, the more dilute silicates may require a more extensive drying to set than the more concentrated silicates. Preferably drying is sufficient to evaporate 50%–70% of the water content of the binder, while the preferred drying time is less than one or two minutes. Surprisingly, when the mold and core parts are set aside, they will then continue to gain in tensile strength.

By way of illustration, for example, in one series of tests a foundry sand bound with RU grade sodium silicate, has an initial water content of 13 moles of water for each mold of sodium silicate. If sufficient water was removed to reduce the water content of the silicate in the green sand to 9.5 moles per mole of sodium silicate, an initial set strength of 20 psi was obtained. When drying was continued to decrease the water content of the sodium silicate to 7 moles, the initial set strength was 45–60 pounds. Further drying decreasing the water content to 4 moles increased the set strength to over 100 psi. The experiment was discontinued when the water content of the sodium silicate had been reduced to 2.3 moles, at which point a set strength of 150 pounds per square inch had been obtained.

When working in a comparable series with grade N sodium silicate, more water was present, and less strength was obtained. Grade N sodium silicate initially contained 23 moles of water per mole of sodium silicate. I was able to dry a green sand using grade N sodium silicate as a binder to the point where the silicate contained only 7 moles of water, at which point the set strength of the mold was 78 pounds per square inch. Difficulty was experienced, however, in further reducing the water content of the grade N sodium silicate.

The present invention has applications in areas other than construction of foundry molds. One application of it, for example, is in the manufacture of plywood. Laminates of wood may be adhered, for example, with silicates in accordance with the present invention. In this case, a layer of a silicate binding agent is cast or otherwise applied to the surface of the wood laminates to be adhered, and then they are pressed and, electronically heated, for example, by microwave heating, to rapidly extract the water. Rapid extraction of water from the adhesive layer is accelerated when wood is bound using the present invention because of the wicking or absorbing characteristics of the wood, which tends to extract water from the silicate.

It has been found, in this connection, that silicates tend to be brittle. For this reason, bond stabilization of the silicates can be provided, thereby reducing brittleness. Such stabilization is obtained by addition of one or more of the adjuvants described above.

The present invention is also applicable in the manufacture of composite of various shapes, such as charcoal briquettes, particle board, ore briquettes, and the like. The procedure in manufacturing such briquettes is generally the same as that followed in the manufacture of foundry molds. In such cases, it may be desirable to increase the amount of silicate binder generally to a range of 6–100 parts by weight for each 100 parts by weight of the particulate material to be bound into a composite. The green mixture should be of a putty-like consistency and retain sufficient porosity that water vapor within the interstices of the desired shape can escape during the rapid drying step described above. In the case of such evaporation, the drying time may be extended for up to five to ten minutes.

The selection of silicate binders follows the same general principles, bearing in mind that particularly in the case of ores that some ores may be reactive with the soluble silicates, and in such cases the silicate must be selected so that it will retain its binding capacity in the presence of the ore to be briquetted.

EXAMPLE 1

One kilo of a foundry sand from Martin-Marietta Company identified as Portage-60 having an average particle size of about 60 mesh, was combined with 20.4 grams of Type RU soluble silicate, Philadelphia Quartz Company, and 13.6 grams of an adjuvant prepared in accordance with Example 5 of British Pat. No. 1,309,606. Type RU is a sodium silicate having a silica to sodium oxide ratio of 2.4 and containing 47% solids. The green sand was packed into sample molds in the shape of standard A.F.S. tensile test specimens. The top and the bottom of the mold box were Plexiglass perforated with 90 holes having an open space of about 5% of the face of the sample.

Hot air at 220° F. was sucked through the mold at a rate of about 100 CFM by the aid of a vacuum pump at the bottom face of the mold box such as shown in FIG. 1 for a period of time between 10 and 60 seconds. The samples were tested immediately for water loss and their instant tensile strength loss.

The following results were obtained.

| | Instantaneous Tensile Strength psi | Water Loss | Percentage* |
|---|---|---|---|
| 10 seconds | 30 psi | 0.43 gms. | 30% |
| 15 seconds | 32 psi | 0.56 gms. | 39.4% |
| 20 seconds | 58 psi | 0.70 gms. | 49.2% |
| 30 seconds | 88 psi | 0.90 gms. | 63% |
| 40 seconds | 128 psi | 1.00 gms. | 70% |
| 50 seconds | 174 psi | 1.09 gms. | 77.7% |
| 60 seconds | (no break)** | 1.19 gms. | 83.9% |

*The percentage of water loss is based on the total amount of water initially present in the green sand.
**Tensile strength over 400 psi.

Improved results were obtained when the perforated plexiglass faces of the mold box were replaced by a wire screen.

EXAMPLE 2

1½ kilograms of New Jersey silica 50 (New Jersey Silica Company, average particle size 50) was combined with 24.2 gms. of a soluble silicate prepared by evaporating 12 gms. of water from 200 gms. of Type RU soluble silicate (Philadelphia Quartz Company) and adding 2 gms. sodium hydroxide thereto. In addition, 17.6 gms. of adjuvant P-13 were blended into the green sand.

P-13 adjuvant was prepared by combining 400 gms. of glucose (9% water), 6.6 gms. of maleic anhydride and 2.66 gms. of boric acid, the mixture was heated to 122°–131° C. for one hour during which 22.6 gms. of water was lost. While still hot, 40 cc. of 10% sodium hydroxide and 34 cc. of water were added. The mixture, when cooled to room temperature, was tacky and capable of drying in air.

The green sand was packed into a mold for tensile bar samples and hardened by drying air therethrough at 220° F., as described in Example 1, for 10 to 45 seconds. The following results were obtained:

| Drying Time | Instantaneous Tensile Strength psi | Water Loss, grams |
|---|---|---|
| 10 seconds | 24 psi | 0.4 gms. |
| 15 seconds | 40 psi | 0.55 gms. |
| 20 seconds | 46 psi | 0.57 gms. |
| 30 seconds | 58 psi | 0.64 gms. |
| 45 seconds | 104 psi | 0.86 gms. |

EXAMPLE 3

1.0 kilograms of Wedron sand (Wedron Silica Company: 120 average particle size) was combined with Type N soluble silicate (Philadelphia Quartz Company). Type N soluble silicate has a silica to sodium oxide ratio of 3.22 and contains 37% solids. The green sand in this example contains 4.43% of the silicate binder.

The green sand was packed into tensile bars and hardened using air which had been heated to 220° F. as described in Example 1. The following results were obtained:

| Drying Time | Instantaneous Tensile Strength psi | Water content, moles Water/Mole N* |
|---|---|---|
| 20 seconds | 12 psi | 17.6 |
| 30 seconds | 30 psi | 15. |
| 45 seconds | 36 psi | 12.8 |
| 55 seconds | 40 psi | 11.8 |
| 90 seconds | 78 psi | 6.7 |

*The amount of drying in this example is reported as the amount of water remaining in the silicate binder expressed as a molar ratio of water to silicate solids. For Type N silicate the initial ratio is 23.

EXAMPLE 4

The effect of varying the porosity of the top and bottom faces of the mold was investigated. Standard tensile bars were prepared in molds in which the porosity of the top and bottom faces were increased by increasing the number of perforations drilled. For purposes of this test, a green sand was used prepared from one kilogram of 26 average particle size Portage sand (as in Example 1) combined with 34.6 gms. of Type RU soluble silicate. The samples were packed into standard tensile bars and hardened with 220° F. air for 40 seconds as in Example 1. The following results were obtained:

| No. of holes | Instantaneous Tensile Strength psi | Percentage Water Loss |
|---|---|---|
| 14 | 0 | 16.3% |
| 34 | 20 | 25.6% |
| 96 | 160 | 59.9% |
| 190 | 312 | 64.8% |

In the foregoing table, the hole size used in each case was the same. When 190 holes had been drilled in the top and bottom faces, the open area within the sample area was 10%.

EXAMPLE 5

The effect of varying drying conditions were further studied in the following series of experiments:

One kilogram of Portage sand average particle size 60, 20.4 grams Type RU sodium silicate and 13.6 grams of P-14 adjuvant were combined to make a green sand. The green sand was cured in standard tensile bar moles using 220° F. air as in Example 1.

The P-14 adjuvant used in this example was prepared by combining 400 grams of glucose (9% water), 6.6 grams citric acid and 2.66 grams of boric acid. The reaction was carried out as described in Example 2.

(A) In a first test, the sample was treated in the normal manner, the top and bottom plates containing 190 holes having 10% open area. During 60 seconds curing time, the sample lost one gram of water and achieved a tensile strength of 220 psi.

(B) The test A was repeated using, however, room temperature air rather than 220° F. air. In 60 seconds only 0.62 grams were lost, and the tensile strength achieved was only 80 psi.

(C) Test B was repeated using the same vacuum pump, but replacing the top plate of the mold with a plate having no perforations at all. In this test the water loss was further reduced, to 0.53 grams and the tensile strength achieved in 60 seconds was only 60 psi.

EXAMPLE 6

An ammoniated silicate for use in accordance with the present invention was prepared as follows:

38 grams of Type N soluble silicate (silica to sodium oxide ratio 2.33, 37% solids) were combined with 3.8 grams of concentrated ammonium hydroxide (28% ammonia). The mixture was shaken intensely for a minute or two. At this point slight gel appeared. The mixture was then allowed to set overnight. The following day the gel had disappeared and a homogeneous solution resulted which was more fluid than the original Type N soluble silicate.

EXAMPLE 7

41 grams of a sodium, ammonium silicate prepared as in Example 6 were combined with 1 kg. Portage sand of average particle size 60. The mixture was packed into standard tensile test molds and hardened in 220° F. air as described in Example 1. The following results were obtained:

| Drying Time | Instantaneous Tensile Strength psi | Water Loss | |
|---|---|---|---|
| | | Grams | Percent |
| 20 seconds | 24 | 0.89 | 34.4 |
| 30 seconds | 60 | 1.30 | 50.3 |
| 45 seconds | 93 | 1.69 | 65.5 |
| 55 seconds | 125 | 1.97 | 76.3 |
| 65 seconds | 190 | 2.12 | 82.1 |
| 75 seconds | 168 | 2.23 | 86.4 |

For comparison purposes, a similar sample was made using Type N soluble silicate as a binder without any ammonia having been added thereto. When these samples were tested for strength, the following results were obtained:

| Drying Time | Instantaneous Tensile Strength psi |
|---|---|
| 20 seconds | 18 |
| 30 seconds | 40 |
| 45 seconds | 64 |
| 55 seconds | 88 |
| 65 seconds | 88 |
| 75 seconds | 116 |

EXAMPLE 8

Following generally the procedures of Examples 6 and 7, an ammoniated silicate was prepared from Type RU soluble silicate to which ammonia has been added to provide an ammoniated silicate containing 2% ammonia. 20 grams of the ammoniated sodium silicate were combined with 1 kg. of Portage sand. The mixture was packed into standard tensile test molds and dried in 220° F. air as described in Example 1. For comparison purposes, corresponding samples were made from a mixture of 1 kilogram of Portage sand with 22 grams of Type RU soluble silicate. The following results were obtained:

| Drying Time | Instantaneous Tensile Strength psi: Type RU plus 2% Ammonia | Type RU |
|---|---|---|
| 10 seconds | 26 | 18 |
| 15 seconds | 52 | 32 |
| 20 seconds | 80 | 48 |
| 25 seconds | 98 | 62 |
| 30 seconds | 98 | 84 |
| 45 seconds | 160 | 84 |

EXAMPLE 9

Portage sand (average particle size 60) was used to make a green foundry sand of the following composition:

1.5% Type RU soluble silicate 0.68% of an adjuvant prepared in accordance with Example 5 of British Pat. 1,309,606

0.1% borax 0.24% of a styrene butadiene resin latex, known as Dylex 553, from the Arco Chemical Company The green sand contained 1.093% water. It was packed into standard tensile bar molds and hardened in 220° F. air in accordance with Example 1. The following results were obtained:

| Drying Time | Tensile Strength psi: Instantaneous | After 1 hr.** | After 24 hrs.** | Instantaneous Water Loss: Grams | Percent* |
|---|---|---|---|---|---|
| 10 seconds | 20 | — | — | 0.36 | 33% |
| 15 seconds | 28 | — | — | 0.46 | 42% |
| 20 seconds | 52 | 80 | — | 0.60 | 54.9% |
| 25 seconds | — | 100 | 124 | — | — |
| 30 seconds | 78 | — | — | 0.83 | 75.9% |
| 45 seconds | 88 | — | — | 0.89 | 81.4% |

*Expressed as percent of total water present

**Tensile strength of these samples were also measured after the samples had been allowed to age for the indicated period of time at ambient conditions which at the time of the test were 70° F. relative humidity 64%.

EXAMPLE 10

Green sands suitable for use in the present invention can be prepared of the following compositions generally in accordance with the procedures of Examples 1 and 2:

| | A | B | C | D |
|---|---|---|---|---|
| Sand | 1.5 kg. | 1.5 kg. | 1.5 kg. | 1.5 kg. |
| Silicate binder | 28.2 gms. | 28.2 gms. | 28.2 gms. | 28.2 gms. |
| Sucrose | 15 gms. | | | |
| Glucose | | 16 gms. | | |
| Corn syrup | | | 17 gms. | |
| Urea furfural resins | | | | 15 gms. |

EXAMPLE 11

1.5 klograms of foundry sand from the New Jersey Silica Company having an average particle size of 50 were combined with 40.3 grams of a binder prepared by blending the following:

28 grams of a soluble silicate prepared as described in Example 2.

14 grams of a quaternary ammonium silicate prepared in accordance with U.S. Pat. No. 3,239,521 obtained from the Philadelphia Quartz Company and identified as "Q-220".

20 grams of an adjuvant prepared in accordance with Example 5 of British Pat. No. 1,309,606.

The green sand was packed into standard tensile bar molds and hardened by forcing cold air through it at a flow rate of 30 to 40 cu. ft. per minute. The following results were obtained:

| Drying Time | Tensile Strength, psi | Water Loss, gms. |
|---|---|---|
| 1 min. | 12 | 0.4 |
| 1' 30" | 30 | 0.57 |
| 2' | 52 | approx. 0.6 |

Since the standard tensile test bar contains about 100 grams of material (AFS Mold and Core Test Handbook, Section 11), the ventilation rates in this example correspond to flow rates through the sample of at least about 30 cubic feet per minute per 100 grams of sand.

EXAMPLE 12

In accordance with the present invention, the amount of silicate in the binder may be varied, particularly where adjuvants were used. In some cases the adjuvant was P-13 (see Example 2). In other cases the adjuvants of Example 5 of British Pat. No. 1,309,606. The following samples were prepared generally following the procedure of Example 1 (percentages being expressed as weight percent of the green sand):

| | A | B | C | D | E | F |
|---|---|---|---|---|---|---|
| Soluble Silicate Binder | 2.14% | 1.88% | 1.61% | 0.813% | 0.546% | 0 |
| Adjuvant | 0.84% | 1.0% | 1.17% | 1.67% | 1.8% | 2.4% |
| Tensile Strength at 45 seconds | 134 psi | 145 psi | 104 psi | 78 psi | 72 psi | 64* psi |

*After 30 minutes the strength had risen to 96 psi.

EXAMPLE 13

A series of ammoniated sodium silicates were prepared by adding ammonium hydroxide (28%) to various sodium silicate solutions. Immediately following addition of the ammonium hydroxide, the mixture was vigorously stirred by hand for 30 to 40 minutes and then allowed to age at least 3 to 4 hrs. (in some samples aging was overnight). The amount added was sufficient, in each sample to increase the alkalinity to the equivalent of a 2.1 ratio silicate.

Tensile test bars were then prepared using sand containing about 1½% silicate binder (dry solid basis). For comparison purposes, a similar series of samples were prepared from the sodium silicates employed in these tests before ammonia had been added. The following results were obtained:

| Sodium Silicate Type | Soda/Silica Ratio | Sample Drying Time | Tensile Strength: Initial Sodium Silicate | Ammoniated Sodium Silicate |
|---|---|---|---|---|
| Type RU | 2.4 | 45 sec. | 84 | 160 |
| Type K | 2.88 | 120 sec. | 110 | 178 |
| Type N | 3.2 | 45 sec. | 64 | 93 |
| Type S-35 | 3.75 | 90 sec. | 22 | 28 |

EXAMPLE 14

Plywood was prepared in accordance with the present invention by bonding ⅛" laminates of wood, in one case with soluble silicate Type RU (identified below as sample A) and in the second case, soluble silicate Type N (identified below as sample B). Additional samples were prepared in which 10 parts of Type RU soluble silicate or Type N soluble silicate were respectively combined with 5 parts of the adjuvant described in Example 5 of British Pat. No. 1,309,606. These samples are respectively identified as samples C and D below. Still further examples of plywood were prepared in accordance with the present invention using an adhesive prepared from 10 parts Type RU or 10 parts of Type N soluble silicate respectively combined with 5 parts of the adjuvant of Example 5 of the British Pat. No. 1,309,606 and 1.5 parts of a styrene butadiene resin.

Each of the samples thus prepared was heated in a home microwave oven for 25 seconds to harden the silicate. The oven operated at a frequency of 2450 megacycles and was rated at 1500 watts. In parallel with the heating of samples, a small watch glass having 1.5 grams of the binder was heated to provide a measure of water lost from the binder caused by the microwave heating.

After each test the watchglass was reweighed to determine water loss. After 24 hrs. each of the samples was sawed into strips of approximately 1 in. width for further testing. Additionally, the loss of water from the binder was estimated.

The following results were obtained:

Sample A-The weight loss determination showed that sample A had lost sufficient water that the soluble silicates remaining were 60% solids (Type RU silica initially contains 47% solids). Sample A could not be cut into test samples because the laminates shattered under the vibration of the saw.

Sample B-The water loss measurement showed that the soluble silicate remaining in sample B after heating contained 51% water (Type N soluble silicate contains 37.6% solids). Sample B could not be cut into test pieces because the silicate bond shattered under the saw vibration.

Sample C-Water loss measurements showed that the solids content of the silicate binder plus adjuvant increased from 53% to 89%. No splitting occurred when the sample was cut into test pieces. The test sample delaminated after immersion in water for 24 hrs.

Sample D-Water loss measurements showed that the solids content of the soluble silicate--binder mixture increased during drying from 50% to 76%. No splitting occurred when the sample was cut into pieces. After immersion in water for 10 days, the sample had not delaminated.

Sample E-Water loss measurements showed that the solids content of the soluble silicate--adjuvant mixture increased from 57% to 89%. No splitting occurred when the sample was cut under test pieces. Samples immersed in water showed delamination after two days.

Sample F-Water loss measurements showed that the solid content of the binder-adjuvant mixture increased from 60% to 80%. No splitting occurred upon cutting into test pieces. Test pieces did not show delamination even after water immersion for 10 days.

EXAMPLE 15

50 grams of wood shavings with fines removed were combined with 30 grams of ammoniated Type N soluble silicate prepared in accordance with Example 6. In addition, 12 grams of an adjuvant prepared in accordance with Example 5 of British Pat. No. 1,309,606 were included in the binder system. The mixture had a putty-like consistency, but was porous. Samples were packed into standard tensile test specimens and air dried by drawing air across the sample under vacuum at 230° F. for 3 minutes.

The specimens could be sawn within 2 hrs., or could be sanded or otherwise worked.

Additional samples were tested for flammability. It was found that the sample was non-flammable and did not lose its strength under flaming conditions.

The materials produced are porous and could be valuable for their thermal and sound insulating properties, as well as for their mechanical properties. Such adhesively bonded composites can be useful in making molds for the present invention because of their porosity.

It will be recognized that similar component particle compositions can be made from Fiberglass vermiculite diatomaceous earth, asbestos and the like in accordance with the foregoing example.

I claim:

1. A method for manufacturing foundry molds or cores comprising (a) forming a green foundry sand around a pattern in a box having at least two air permeable faces, said sand comprising from 94 to 99.9% of a refractory foundry sand and having 0.1% to 6% by weight of an aqueous solution containing a soluble silicate as a binder, said silicate containing an alkali metal, ammonium, an ammonium complex, or mixtures thereof as a cation and a silicate as the anion, the anion to cation mole ratio being between 1:1 and 4:1, said soluble silicate further containing from 47 to 70% water; and (b) applying a differential pressure between said air permeable faces sufficient to force air therebetween at a rate sufficient in less than two minutes to remove at least 30% of the water contained in said aqueous solution and to harden the sand to an instant tensile strength in excess of that obtainable from hardening said green sand by carbon dioxide gasing.

2. A method for manufacturing foundry molds or cores comprising (a) forming a green foundry sand around a pattern in a box, said sand comprising from 94 to 99.9% of a refractory foundry sand and having 0.1% to 6% by weight of an aqueous solution containing a soluble silicate as a binder, said silicate containing an alkali metal, ammonium, an ammonium complex, or mixtures thereof as a cation and a silicate as the anion, the anion to cation mole ratio being between 1:1 and 4:1, said soluble silicate further containing from 47 to 70% water;

(b) said box having an air permeable face with an open area of at least 1.5%; and (c) subjecting said green sand to a forced drying period not exceeding two minutes, during which at least 30% of the water in said aqueous solution is removed without reaction of said silicate and the core or mold is hardened to an instant tensile strength greater than that obtainable from hardening said green sand by carbon dioxide gasing.

3. In the manufacture of a foundry mold or core wherein a green sand is formed around a pattern in a box, said green sand being a refractory foundry sand containing a binder therefor, said green sand thereafter being hardened around said pattern in said mold box, the improvement which comprises (a) using as a binder for said green sand a soluble silicate containing an alkali metal, ammonium, an ammonium complex, or mixtures thereof as a cation and a silicate as the anion, the anion to cation mold ratio being between 1:1 and 4:1, said soluble silicate further containing from 47 to 70% water to form an aqueous solution, the amount of said aqueous solution being between 0.1% and 6% by weight of said green foundry sand; and (b) providing at least two air permeable faces in said box, said air permeable faces having an open area of at least 1.5%; and (c) applying a differential pressure between said air permeable faces sufficient to force air therebetween at a rate of at least 30 standard cubic feet per minute per 100 grams of sand, said air circulation rate being sufficient within two minutes to increase the solids content of said aqueous solution to at least 54% and to harden the mold to an instant tensile strength in excess of that obtainable from said sand by carbon dioxide gasing.

4. The improvement according to claim 3, in which said air permeable faces have an open area of at least 3%.

5. The improvement according to claim 3, in which said air permeable faces have an open area of at least 10%.

6. A method according to one of claims 1-3, 4 and 5, wherein said green sand contains from 0.1% to 3% by weight of said aqueous solution of a soluble silicate.

7. A method according to one of claims 1-3, 4 and 5, wherein said green sand contains from 1% to 3% by weight of said aqueous solution of a soluble silicate.

8. A method according to one of claims 1-3, 4 and 5, wherein said green said additionally contains an adjuvant effective to enhance the film-forming and strength properties of the silicate binder and to enhance the shake-out characteristics of the mold.

9. A method according to claim 8, wherein said adjuvant is selected from the group consisting of alumina, borax, kaolin, bentonite, synthetic resinous polymeric material, sugar, or mixtures thereof.

10. A method according to claim 8, wherein said adjuvant is a condensation product obtained by combining 44–77% of a reducing sugar, 5–22% urea, 4–19% formaldehyde, and 9–18% water for 15 to 120 minutes at a temperature above the boiling point of water.

11. A method according to claim 8, wherein said adjuvant is a composition prepared by (a) combining (i) a reducing sugar, (ii) a lower dibasic carboxylic acid or acicd anhydride, and (iii) a stabilizer effective to prevent caramelization of the sugar during reaction, said dibasic carboxylic acid or acid anhydride being, on a dry weight basis, from 1 to 12% by weight of said mixture and said stabilizer being, on a dry weight basis, from ½to 2% by weight of said mixture, the balance thereof being made up of said reducing sugar;

(b) heating said mixture to remove water therefrom; and (c) thereafter adding an alkali and water to provide a final product containing from 10% to 25% water and from about ½to 2% of said alkali.

12. A method according to one of claims 1-3, 4 and 5, wherein said soluble silicate is a silicate salt of potassium or sodium.

13. A method according to one of claims 1–3, 4 and 5, wherein said soluble silicate is a salt of an alkali metal having a molar ratio of silicon dioxide to metal oxide between 2.2:1 and 3.8:1 to which has been added ammonium hydroxide in an amount which does not exceed that which increases the alkalinity of said soluble silicate to the equivalent of a soluble silicate having an anion to cation ratio of 1.8.

14. A method according to one of claims 1–3, 4 and 5, wherein the weight ratio of silica to metallic oxide is between 2.2:1 and 3.2:1.

15. A method according to one of claims 2, 3, 4 and 5, wherein heat is generated volumetrically within the mass of sand to be hardened to force removal of said water.

16. A method according to one of claims 1 through 3 and 4 through 5 wherein at least 50% of the water contained in said aqueous solution of a soluble silicate is removed within 2 minutes.

17. A method according to claim 16, wherein at least 70% of the water in said aqueous solution of a soluble silicate is removed within 2 minutes.

18. A method according to one of claims 1 through 3 and 4 through 5, wherein at least 50% of the water in said aqueous solution of a soluble silicate is removed within one minute.

19. A method according to claim 18, wherein at least 70% of the water of said aqueous solution of the soluble silicate is removed within one minute.

20. A method for forming a desired shape from a particulate material comprising (a) forming a green mixture of said particulate material and an aqueous solution of a soluble silicate as a binder into a mold having said desired shape and at least two air permeable faces, said green mixture containing from 6 to 100 parts by weight of said soluble silicate for each 100 parts by weight of said particulate material, the amount of said aqueous solution being sufficient, when combined with said particulate material, to form a porous, plastic mass, said soluble silicate containing an alkali metal, ammonium, an ammonium complex, or mixtures thereof, as a cation and a silicate as the anion, the anion to cation mole ratio being between 1:1 and 4:1, said soluble silicate further containing from 47 to 70% water; and (b) applying a differential pressure between said air permeable faces sufficient to force air therebetween at a rate sufficient, within two minutes, to remove at least 30% of the water from said aqueous solution containing a soluble silicate, and to harden the green mixture to a tensile strength of at least 20 pounds per square inch.

21. A method for forming a desired shape from a particulate material comprising (a) molding a green mixture of said particulate material and an aqueous solution of a soluble silicate as a binder into said desired shape, said green mixture containing from 6 to 100 parts by weight of said aqueous solution for each 100 parts by weight of said particulate material, the amount of said aqueous solution being sufficient to form a porous, plastic mass when combined with said particulate material, said soluble silicate containing an alkali metal, ammonium, an ammonium complex, or mixtures thereof as a cation, and a silicate as the anion, the anion to cation mole ratio being between 1:1 and 4:1, said soluble silicate further containing from 47 to 70% water;

(b) said green mixture being molded in a box having an air permeable face with an open area of at least 1.5%; and (c) subjecting said molded shape to a force drying period of not more than about two minutes, during which at least 30% of the water in said aqueous solution is evaporated and said molded shape is hardened to a tensile strength of at least 20 pounds per square inch.

22. In the manufacture of a desired shape by forming a green mixture of a particulate material containing a binder therefor, into a mold having the desired shape and thereafter hardening said green mixture, the improvement which comprises (a) using as a binder for said green mixture an aqueous solution of a soluble silicate containing an alkali metal, ammonium, an ammonium complex, or mixtures thereof, as a cation and a silicate as the anion, the anion to cation mole ratio being between 1:1 and 4:1, the amount of said aqueous solution being between 6 and 100 parts by weight for each 100 parts by weight of said particulate material; and (b) providing at least two air permeable faces in said mold, said air permeable faces having an open area of at least 1.5%; and (c) applying a differential pressure between said air permeable faces sufficient to force air therebetween at a rate of at least 30 standard cubic feet per minute per 100 grams of said green mixture and within two minutes to evaporate at least 30% of the water from said aqueous solution, to increase the solids content thereof to at least 54% and harden said molded shape to a tensile strength of at least 20 pounds per square inch.

23. The improvement according to claim 22, wherein said air permeable faces have an open area of at least 3%.

24. The improvement according to claim 2, wherein said air permeable faces have an open area of at least 10%.

25. A molded particulate material according to one of claims 20–22, 23 and 24, wherein there is further provided an adjuvant effective to improve the elasticity of the silicate binder used therein.

26. A particle board in accordance with one of claims 20–22, 23 and 24, wherein said particulate material is wood chips, wood savings, saw dust, vermiculite, asbestos or mixtures thereof.

27. A sand mold for casting metals comprising a foundry sand hardened with a binder prepared in accordance with one of claims 1–3.

* * * * *

UNITED STATES PATENT AND TRADEMARK OFFICE

CERTIFICATE OF CORRECTION

PATENT NO. : 4,226,277

DATED : October 7, 1980

INVENTOR(S) : Ralph Matalon

It is certified that error appears in the above—identified patent and that said Letters Patent is hereby corrected as shown below:

First page, 3rd line of ABSTRACT, "foundary" should read --foundry--;

Col. 3, line 7, "collodial" should read --colloidal--;

Col. 3, line 51, "structure" should read --structures--;

Col. 6, line 55, "high" should read --higher--;

Col. 7, line 47, "retains" should read --retain--;

Col. 8, line 34, "extend" should read --extent--;

Col. 17, line 13, "mold" should read --mole--;

Col. 17, line 43, "said" should read --sand--;

Col. 17, line 59, "acicd" should read --acid--;

Col. 20, line 16, "claim 2" should read --claim 22--.

Signed and Sealed this

*Tenth* Day of *February 1981*

[SEAL]

*Attest:*

RENE D. TEGTMEYER

*Attesting Officer*

*Acting Commissioner of Patents and Trademarks*